US011160410B2

(12) United States Patent
Roesel, Jr.

(10) Patent No.: US 11,160,410 B2
(45) Date of Patent: Nov. 2, 2021

(54) CANDLE LID CONNECTING DEVICE

(71) Applicant: Lid Latcher, LLC, West Chester, OH (US)

(72) Inventor: Kenneth E. Roesel, Jr., Liberty Township, OH (US)

(73) Assignee: Lid Latcher, LLC, West Chester, OH (US)

( * ) Notice: Subject to any disclaimer, the term of this patent is extended or adjusted under 35 U.S.C. 154(b) by 0 days.

(21) Appl. No.: 16/715,191

(22) Filed: Dec. 16, 2019

(65) Prior Publication Data

US 2020/0187696 A1 Jun. 18, 2020

Related U.S. Application Data

(60) Provisional application No. 62/780,978, filed on Dec. 18, 2018.

(51) Int. Cl.
*A47G 33/08* (2006.01)

(52) U.S. Cl.
CPC ..... *A47G 33/08* (2013.01)

(58) Field of Classification Search
CPC ..... A47G 33/08
USPC ..... 428/7
See application file for complete search history.

(56) References Cited

U.S. PATENT DOCUMENTS 4,456,124 A * 6/1984 Kay ..... B65D 73/0057 206/463
9,988,177 B1 * 6/2018 Ruprecht ..... B65D 47/122
2004/0129600 A1 * 7/2004 Gueret ..... B65D 43/162 206/581
2009/0107948 A1 * 4/2009 Brand ..... A61J 1/1406 215/247
2014/0044837 A1 * 2/2014 Weisman ..... A47G 19/2205 426/79
2016/0073679 A1 * 3/2016 Rushforth ..... A24F 23/00 131/310

FOREIGN PATENT DOCUMENTS

GB 2501529 A * 10/2013 ..... A45D 40/24

* cited by examiner

*Primary Examiner* — Humera N. Sheikh
*Assistant Examiner* — Katherine A Christy
(74) *Attorney, Agent, or Firm* — Wood Herron & Evans LLP

(57) ABSTRACT

A connecting device for connecting two lids includes a hoop member having first and second edges and at least one inwardly-extending protrusion located at the first edge and at the second edge. The connecting device also includes an outwardly-extending tab affixed to the exterior surface of the hoop member, where the tab has a through hole. The hoop member is sized so as to fit within and engage with two opposing like-shaped lids to form a closed structure. According to one aspect of the invention, two lids are repurposed candle lids that would otherwise be discarded, and the closed structure forms an ornamental apparatus such as a holiday decoration.

7 Claims, 6 Drawing Sheets

CANDLE LID CONNECTING DEVICE

CROSS-REFERENCE TO RELATED APPLICATIONS

This application claims the benefit of U.S. Provisional Patent Application Ser. No. 62/780,978, filed Dec. 18, 2018, the disclosure of which is incorporated by reference herein.

FIELD OF THE INVENTION

This invention relates generally to devices for repurposing candle lids for use as decorative ornaments.

BACKGROUND

Candles are often sold in containers made from glass, metal, or ceramic, for example. In many cases, the containers have a decorative lid to cover the candle when the candle is not being used. One exemplary candle in a container with a decorative lid is shown in FIG. 1.

It is common for the consumer to throw the candle container and the decorative lid away when the candle is used up. Thus, despite being decorative and aesthetically pleasing, the typical consumer believes the lid is no longer of any use and simply throws it away.

SUMMARY OF THE INVENTION

It is an object of the invention to reduce the unnecessary waste associated with conventional candles and their corresponding packaging. To these and other ends, a connecting device for connecting two lids includes a hoop member having first and second edges and at least one inwardly-extending protrusion located at the first edge and at the second edge. The connecting device also includes an outwardly-extending tab affixed to the exterior surface of the hoop member, the tab having a through hole. The hoop member is sized so as to fit within and engage with two lids to form a closed structure. The hoop member preferably has a width between about 0.25 inch and 2.5 inches, and a diameter between about 2.5 and 5 inches.

In one embodiment of the connecting device, the at least one inwardly-extending protrusion on the first edge includes four inwardly-extending protrusions circumferentially spaced apart about 90 degrees around the first edge and wherein the at least one inwardly-extending protrusion on the first edge includes four inwardly-extending protrusions circumferentially spaced apart about 90 degrees around the second edge. In one aspect, the four inwardly-extending protrusions around the first edge are preferably circumferentially offset by about 45 degrees to the four inwardly-extending protrusions around the second edge.

The invention also contemplates an ornamental apparatus including a connecting device including a hoop member having first and second edges and at least one inwardly-extending protrusion located at the first edge and at the second edge. The connecting device also includes an outwardly-extending tab affixed to the exterior surface of the outer rim, the tab having a through hole. The ornamental apparatus further includes first and second lids with each lid having a capturing gasket. The hoop member has an outer diameter and the first and second lids each has an inner diameter. The outer diameter corresponds approximately to the inner diameter, such that the hoop member engages the first and second lids to form a closed structure. The inwardly-extending protrusions engage the capturing gasket of the first and second decorative lids. Each lid may include a decorative element on an exterior surface of each lid. The hoop member preferably has a width between about 0.25 inch and 2.5 inches, a diameter between about 2.5 and 5 inches.

In one embodiment of the ornamental apparatus, each lid has an outer rim and the capturing gasket has an outer perimeter that is spaced away from the outer rim to form a gap therebetween. The hoop member is positioned within the gap such that the hoop member engages the first and second lids.

In one embodiment of the ornamental apparatus, the at least one inwardly-extending protrusion on the first edge includes four inwardly-extending protrusions circumferentially spaced apart about 90 degrees around the first edge and wherein the at least one inwardly-extending protrusion on the first edge includes four inwardly-extending protrusions circumferentially spaced apart about 90 degrees around the second edge. In one aspect, the four inwardly-extending protrusions around the first edge are preferably circumferentially offset by about 45 degrees to the four inwardly-extending protrusions around the second edge.

BRIEF DESCRIPTION OF THE DRAWINGS

The accompanying drawings, which are incorporated in and constitute a part of this specification, illustrate one or more embodiments of the invention and, together with a general description of the invention given above, and the detailed description given below, serve to explain the invention.

DETAILED DESCRIPTION OF THE INVENTION

Figure 2:
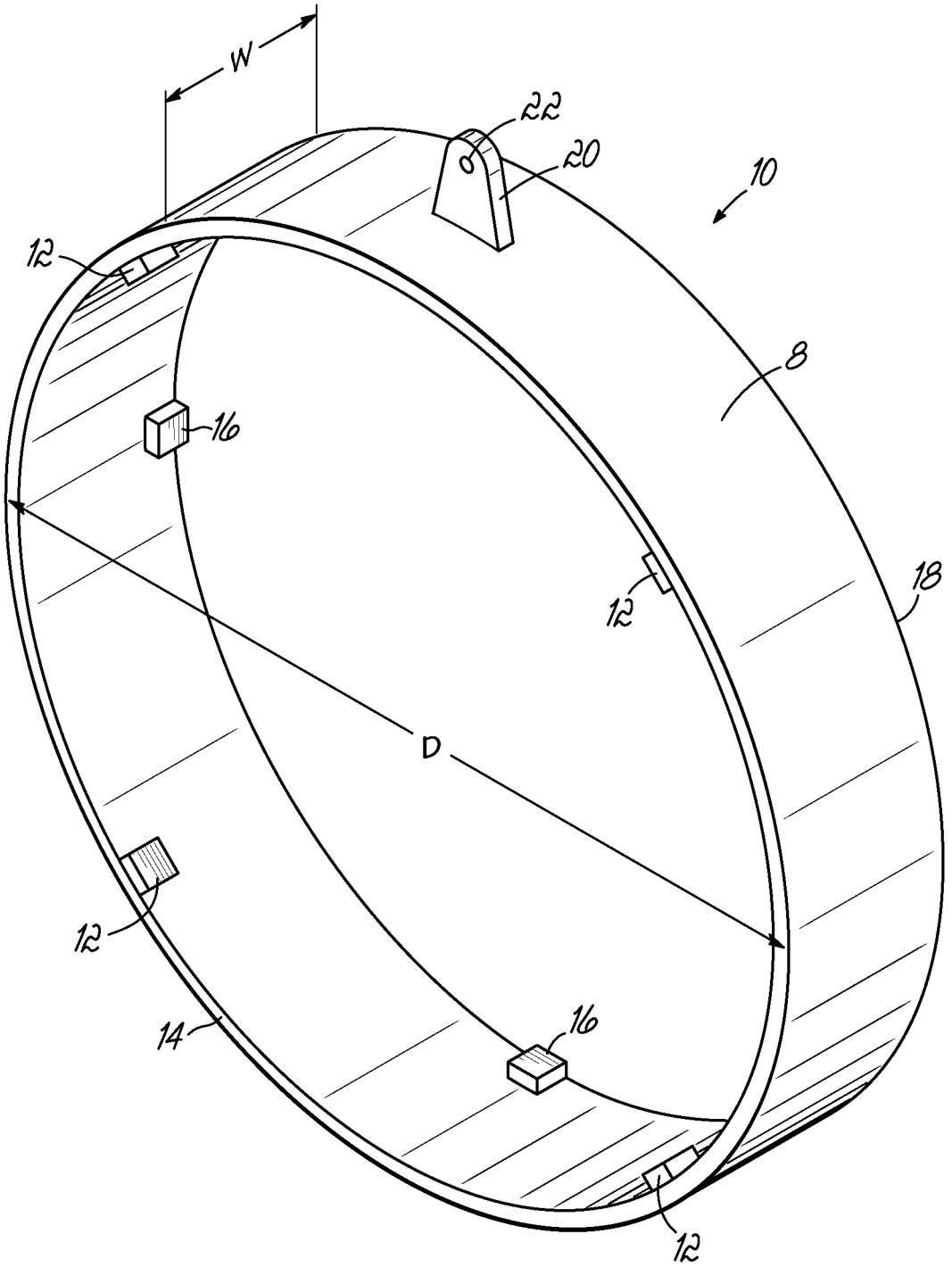
FIG. 2 is a perspective view of a candle lid connecting device according to an embodiment of the invention.

An exemplary candle lid connecting device 10 according to one embodiment is shown in FIG. 2. The connecting device 10 has hoop member 8 that has a first series of spaced-apart, inwardly-extending protrusions 12 on a first edge 14 and a second series of spaced-apart, inwardly-extending protrusions 16 on an opposing second edge 18. In an embodiment, there are four inwardly-extending protrusions 12 spaced apart about 90 degrees around the first edge 14 and four inwardly-extending protrusions 16 spaced apart about 90 degrees around the second edge. As illustrated in FIG. 2, the four inwardly-extending protrusions 12 are offset circumferentially approximately 45 degrees relative to the four inwardly-extending protrusions 16. Additional inwardly-extending protrusions 12, 16 may be added to the first and second edges 14, 18. In addition, the circumferential offset between inwardly-extending protrusions 12, 16 may be something other than 45 degrees as dictated by the number of protrusions present. Attached to the exterior surface of the hoop member 8 is an outwardly-extending tab 20 having a through hole 22.

The connecting device 10 may be constructed of any suitable material, but is preferably made from a flexible material such as rubber, plastic, or metal. An exemplary material may be ABS (Cycolac ABS T4500). The hoop member 8 may be made with different widths, W, such as from 0.25 inch up to 2.5 inches and perhaps even wider depending on the application of the connecting device 10. The hoop member 8 may also be made with different outside diameters, D, such as ranging from 2.5 inches to 5 inches and perhaps greater depending on the application of the connecting device 10.

Figure 1:
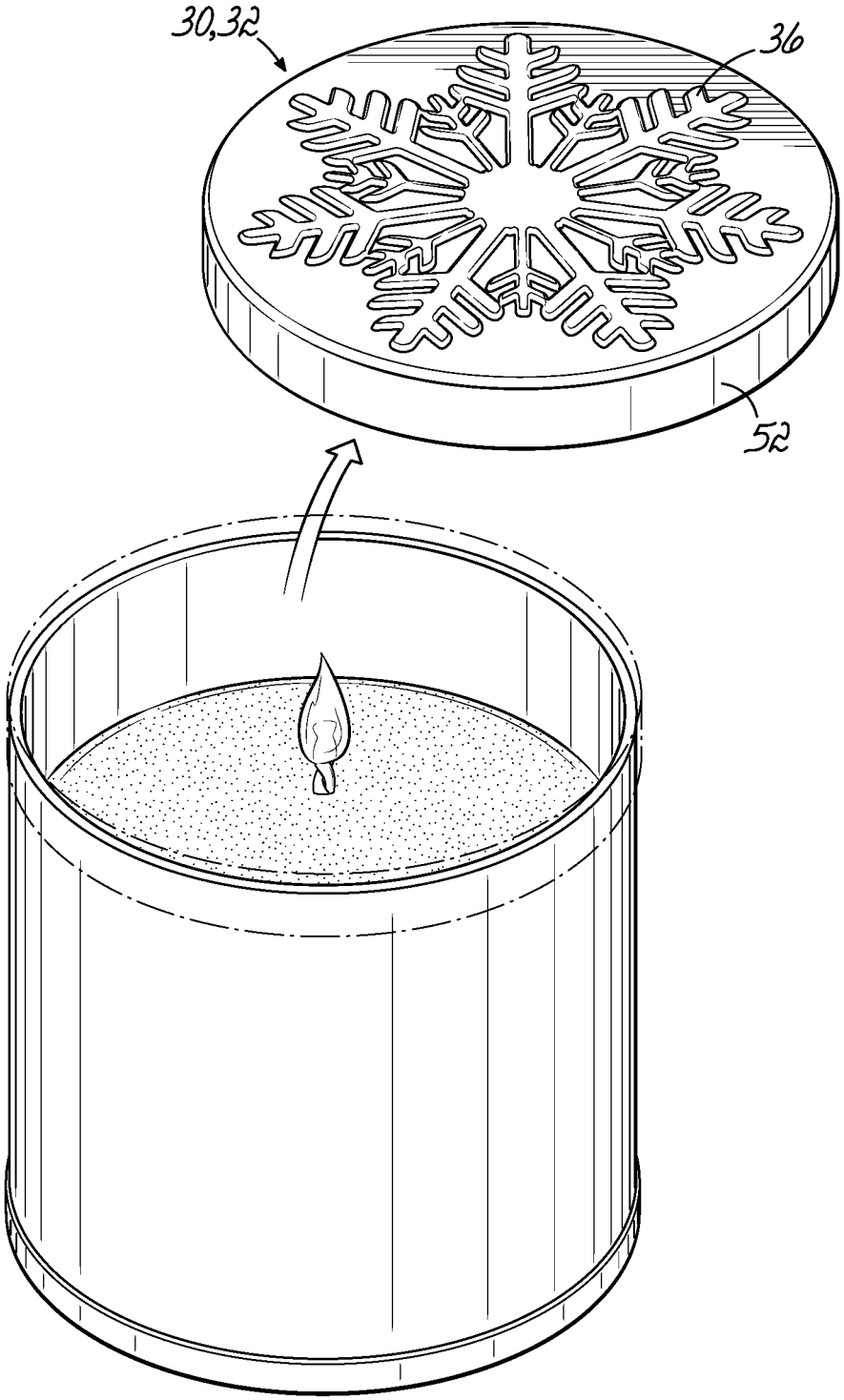
FIG. 1 is a perspective view of a candle container and a decorative lid.
Figure 3A:
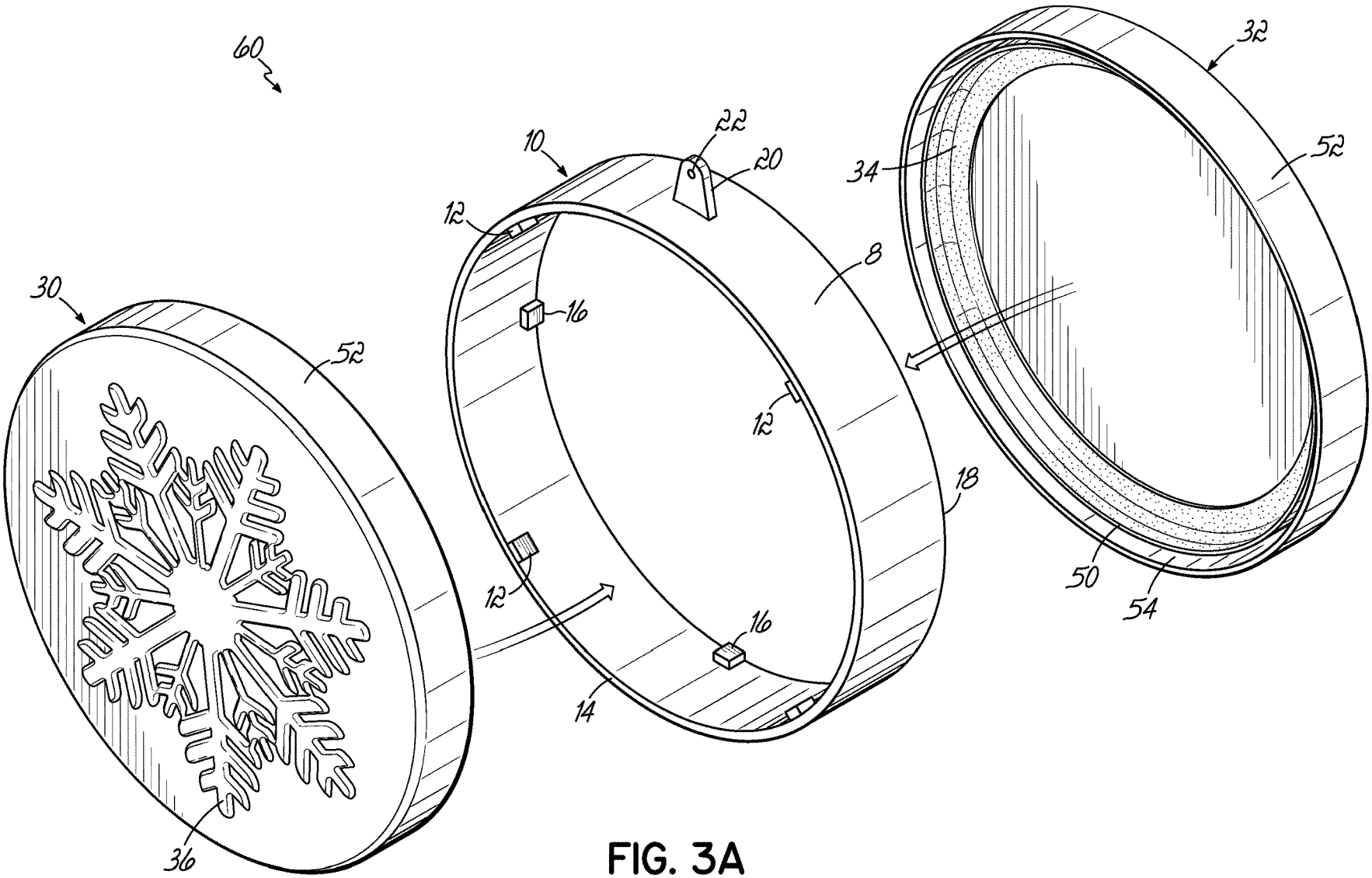
FIG. 3A is an exploded perspective view of the candle lid connecting device of FIG. 2 and two decorative lids.
Figure 3B:
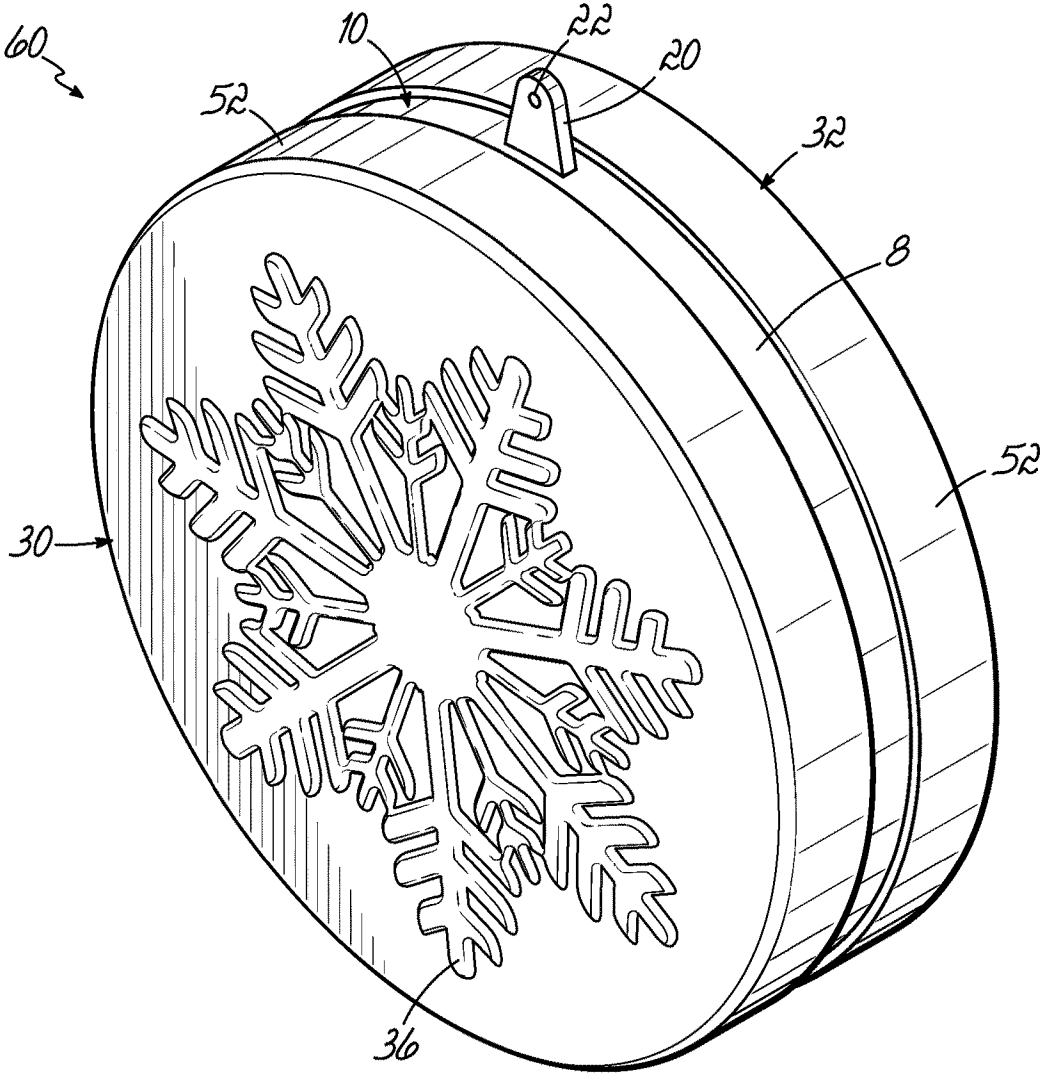
FIG. 3B is a perspective view of the candle lid connecting device of FIG. 2 between two decorative lids.

FIG. 3A illustrates the connecting device 10 positioned between two lids 30, 32 which are of the type originally used on the candle illustrated in FIG. 1. The lids 30, 32 may have a decorative feature 36. Each decorative lid 30, 32 includes a capturing gasket 34, which was used to seal the decorative lid 30, 32 to the candle container. In one embodiment, the capturing gasket 34 has a flexible outer perimeter 50 extending about the circumference of the capturing gasket 34. FIG. 3B illustrates the connecting device 10 inserted into the two decorative lids 30, 32. As shown in FIG. 3B, the outside diameter D of hoop member 8 of the connecting device 10 generally corresponds to the inner diameter of the decorative lids 30, 32 such that the hoop member 8 may be inserted into and fit snuggly inside an outer rim 52 of the decorative lids 30, 32.

Figure 4A:
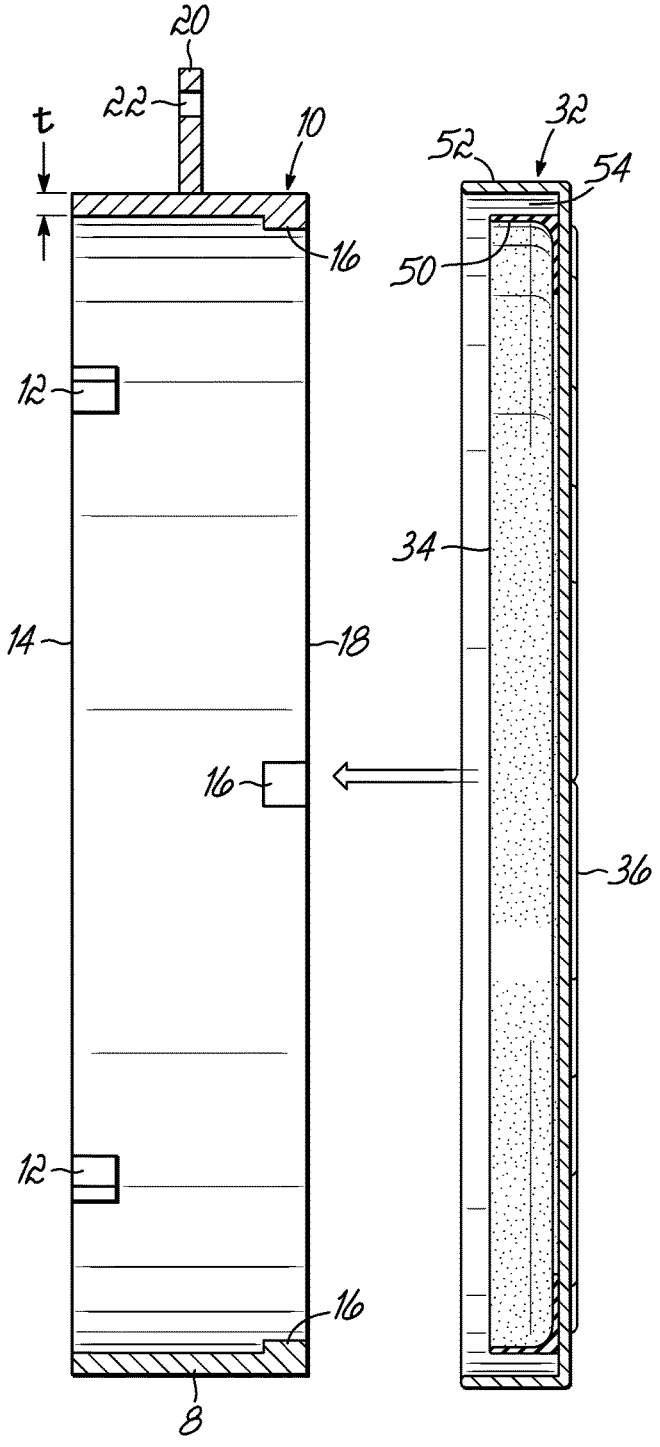
FIG. 4A is a cross-sectional view of the candle lid connecting device of FIG. 2 with the decorative lid detached from the candle lid connecting device.
Figure 4B:
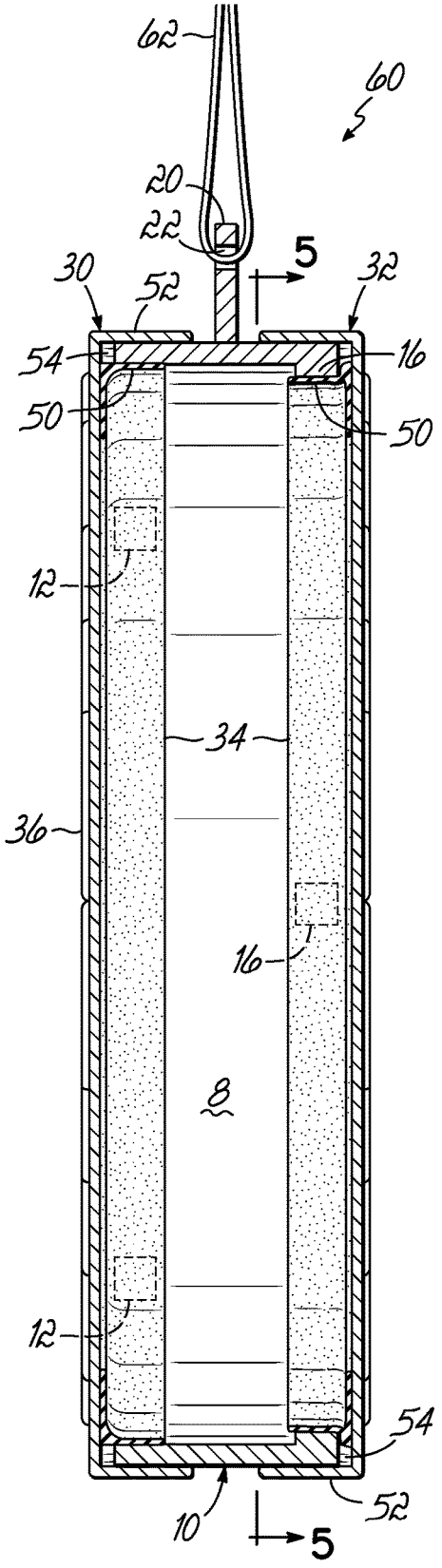
FIG. 4B is a cross-sectional view of the candle lid connecting device of FIG. 2 with the decorative lid attached to the candle lid connecting device.
Figure 5:
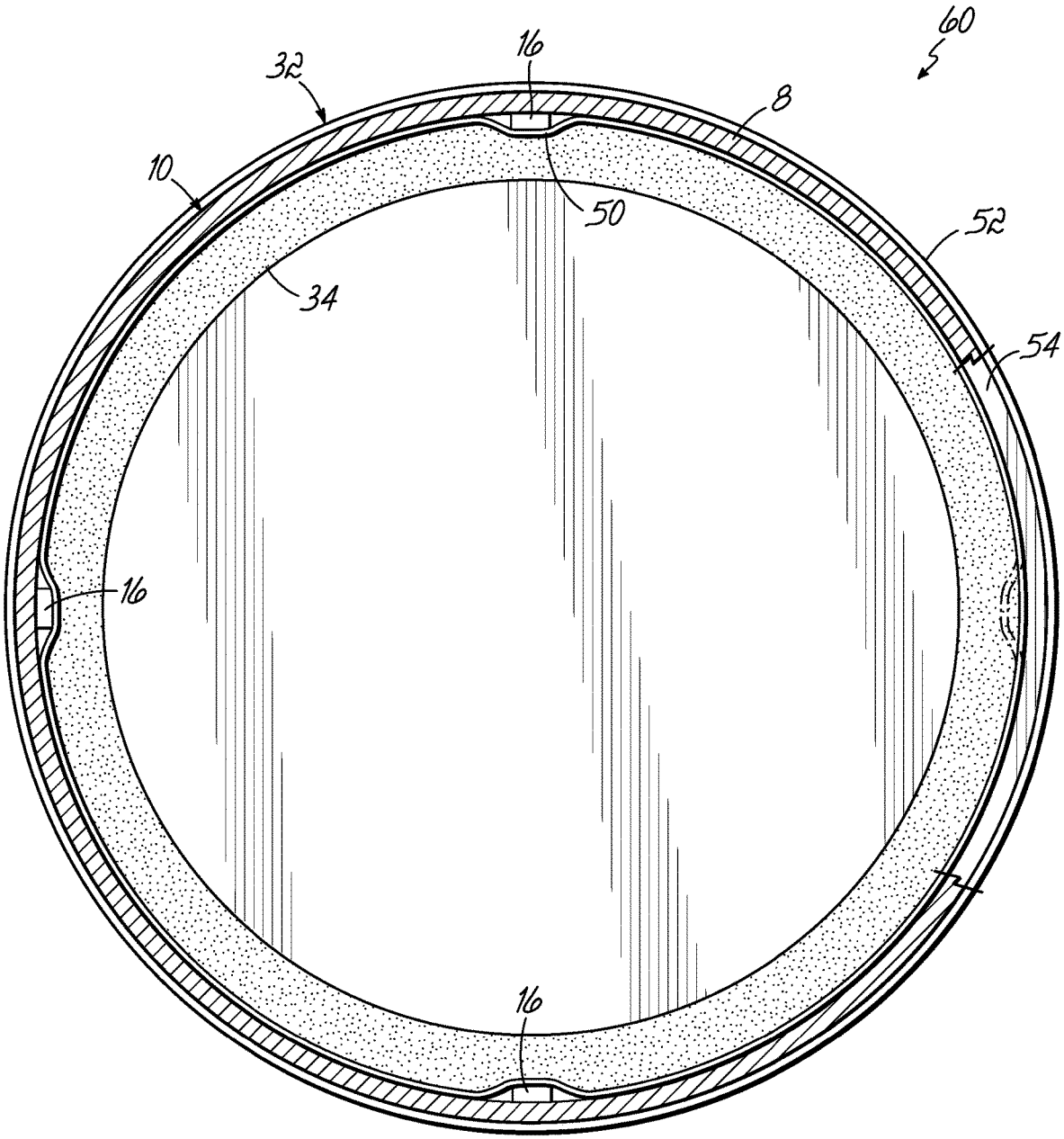
FIG. 5 is a cross-sectional view taken along lines 5-5 of the candle lid connecting device inserted into a decorative lid shown in FIG. 4B.

In one embodiment, the outer perimeter 50 of the capturing gasket 34 may be spaced slightly away from the hoop member 8 of the connecting device 10 to thereby form a gap 54 therebetween as illustrated in FIG. 4A. The gap 54 is generally slightly smaller than the thickness, t, of the hoop member 8. As such, the hoop member 8 may be inserted into the gap 54 and held between the flexible outer perimeter 50 and the hoop member 8. When the protrusions 12, 16 are inserted into the gap 54 the flexible outer perimeter 50 has to flex inwardly to allow the protrusions 12, 16 to enter the gap 54 as illustrated in FIGS. 4B and 5. As such, the protrusions 12, 16 engage with the outer perimeter 50 and tuck into the gap 54 so as to more positively secure the hoop member 8 and thus the connecting device 10 to the decorative lid 30 as shown in FIGS. 4B and 5. If one of the decorative lids 30, 32 does not already have the capturing gasket 34, then a capturing gasket 34 may be added to that decorative lid 30, 32 so the protrusions 16 may engage (tuck under) the capturing gasket 34.

As shown in FIGS. 3B, 4B, and 5, the hoop member 8 of the connecting device 10 is inserted inside the gap 54 of decorative lids 30, 32 to yield a closed structure, such as ornamental apparatus 60. The width, W, of the hoop member 8 is such that the decorative lids 30, 32 nearly contact outwardly-extending tab 20 when the hoop member 8 is inserted fully inside the decorative lids 30, 32. It will be appreciated that the width, W, of the hoop member 8 can varying depending on the depth of the decorative lids 30, 32. As the depth of the decorative lids 30, 32, increases, the width, W, of the hoop member 8 should also increase so that the protrusions 12, 16 may substantially engage the capturing gasket 34.

As shown in FIG. 4B, when the decorative lids 30, 32 are fully engaged with the hoop member 8, a string or line 62 may be inserted into the through hole 22 such that the ornamental apparatus 60 may be hung up, such as on a fireplace mantel or Christmas tree, for example.

The connecting device 10 may come in a variety of colors, such as primary colors, so as to coordinate with the décor of the lids or home interiors. The connecting device 10 may have a swirl pattern in its color or it may be silvered to match the decorative lids 30, 32. The exterior surface of the hoop member 8 may also be embossed with a design or have a layer with a design on it so as to coordinate with a particular holiday, season of the year, a special event, milestone, or the décor of home interiors, for example. The exterior surface of the hoop member 8 may be decorated with a limited edition design, a collector's design, as well as with sports themes.

The ornamental apparatus 60 may be used as a tree ornament, a holiday decoration, a gift card holder, a jewelry box, and a decorative box.

While the invention has been illustrated by a description of various embodiments, and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of the Applicant's general inventive concept.

What is claimed is:

1. An ornamental apparatus, comprising:

a connecting device comprising:

a hoop member having first and second opposite edges;

a first inwardly-extending protrusion located on an interior surface of the hoop member and extending inwardly from the first edge and a second inwardly-extending protrusion located on the interior surface of the hoop member and extending inwardly from the second edge; and an outwardly-extending tab affixed to an exterior surface of the hoop member, the outwardly-extending tab having a through hole; and first and second lids, each lid having a capturing gasket;

wherein the hoop member has an outer diameter and the first and second lids each has an inner diameter, wherein the outer diameter corresponds approximately to the inner diameter, such that the hoop member engages the first and second lids to form a closed structure, and wherein each lid has an outer rim and each capturing gasket of the first and second lids has an outer perimeter that is spaced away from the respective outer rims of the first and second lids to form a gap therebetween, wherein the hoop member is positioned within the gap between each capturing gasket and respective outer rims of the first and second lids such that the hoop member engages the first and second lids.

2. The ornamental apparatus of claim 1, wherein the first inwardly-extending protrusion engages the capturing gasket of the first lid and the second inwardly-extending protrusion engages the capturing gasket of the second lid.

3. The ornamental apparatus of claim 1, where each lid includes a decorative element on an exterior surface thereof.

4. The connecting device of claim 1, wherein the hoop member has a width between the first edge and the second edge of between 0.25 inch and 2.5 inches.

5. The connecting device of claim 1, wherein the hoop member has an outside diameter between 2.5 and 5 inches.

6. The connecting device of claim 1, wherein the first edge includes four inwardly-extending protrusions circumferentially spaced apart 90 degrees around the first edge and wherein the second edge includes four inwardly-extending protrusions circumferentially spaced apart 90 degrees around the second edge.

7. The connecting device of claim 6, wherein the four inwardly-extending protrusions around the first edge are circumferentially offset by 45 degrees to the four inwardly-extending protrusions around the second edge.

* * * * *